US006431310B1

(12) United States Patent
Heitmann

(10) Patent No.: US 6,431,310 B1
(45) Date of Patent: Aug. 13, 2002

(54) METHOD FOR REDUCING THE NOISE LEVEL OF TOBACCO-PROCESSING MACHINES WITH SOUND-DAMPING LINE SEGMENTS

(75) Inventor: Uwe Heitmann, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/650,741

(22) Filed: Aug. 30, 2000

(30) Foreign Application Priority Data

Sep. 10, 1999 (DE) ..... 199 43 319

(51) Int. Cl.[7] ..... G10K 11/04
(52) U.S. Cl. ..... 181/200; 181/224; 131/280
(58) Field of Search ..... 181/224, 225, 181/209, 200, 202, 204; 131/280, 283

(56) References Cited

U.S. PATENT DOCUMENTS 3,866,708 A * 2/1975 Rudszinat et al. ..... 131/280

FOREIGN PATENT DOCUMENTS

| | | |
|---|---|---|
| DE | 29 10 371 | 10/1980 |
| DE | 39 31 228 | 3/1990 |
| GB | 1 442 751 | 7/1976 |

* cited by examiner

*Primary Examiner*—Khanh Dang
(74) *Attorney, Agent, or Firm*—Venable; Robert Kinberg

(57) ABSTRACT

A method for reducing noise level in a tobacco-processing production machine that is acted upon by flowing process air includes supplying process air to the production machine predominantly conveyed by sound-damping line segments.

6 Claims, 10 Drawing Sheets

METHOD FOR REDUCING THE NOISE LEVEL OF TOBACCO-PROCESSING MACHINES WITH SOUND-DAMPING LINE SEGMENTS

CROSS-REFERENCE TO RELATED APPLICATIONS

Priority is claimed with respect to application No. EP 19943319.4 filed in the European Patent Office on Sep. 10, 1999, the disclosure of which is incorporated herein by reference.

BACKGROUND OF THE INVENTION

The invention relates to an arrangement for reducing the noise level of tobacco-processing production machines acted upon by flowing process air, particularly in the operator region of a production line comprising at least two production machines disposed at an angle to one another.

Production machines of the tobacco-processing industry primarily encompass cigarette-production machines and filter-attachment machines, which are preferably joined diagonally at a 90° angle to form a production line. The machines may further include packaging machines and other standard tobacco-industry components, such as filter-production machines and article-transport devices, the latter representing a secondary source of noise. Particularly in the aforementioned production line, an operator, who is preferably positioned in the corner zone between two machines, is exposed to a great deal of machine noise. Previous efforts to reduce the noise have been unsuccessful in preventing operating noises created by mechanical components, and flow noises produced by process air, especially suction noises, from being emitted from the machines and entering the operator region, because it is not possible to hermetically seal the machine.

SUMMARY OF THE INVENTION

It is the object of the invention to implement further, more effective anti-noise measures in tobacco-processing production machine.

According to the invention, this object is accomplished in that the process air supplied to the production machines is predominantly conveyed via sound-damping line segments.

In accordance with a preferred modification, such sound-damping line segments are concentrated in a floor region of the production machines.

In accordance with an advantageous modification, the damping measures in the floor region can be particularly effectively supported by the integration of a sound-absorbing floor covering, which is under the production machines, into the sound-damping line segments.

To optimize the anti-noise measures, it is further proposed to provide secondary air-flow gaps as noise dampers between moving or stationary machine or wall sections.

In accordance with advantageous modifications, the flow noises are additionally suppressed by damping mats that form a cladding of the production machines for sound-damping the air-flow gaps.

As a further noise-reduction measure, it is proposed to provide sound-damped air-exit openings on the top of the production machines, so the emitted noise is directed away from the nearby operator region.

The advantage attained with the invention is that, in machines whose noise level is distinguished by a relatively large process-air throughput, such as strand machines and filter-attachment machines having conveying air, including retaining air and control blast air, the flow noises are absorbed, and thus rendered harmless to operating personnel at the locations where the noise is the most intense and has the greatest impact on the operator region, namely in the boundary zone between the surroundings and the machine interior.

BRIEF DESCRIPTION OF THE DRAWINGS

The invention is described in detail below in conjunction with embodiments illustrated in the drawing.

Shown are in.

DETAILED DESCRIPTION OF THE INVENTION

Figure 1:
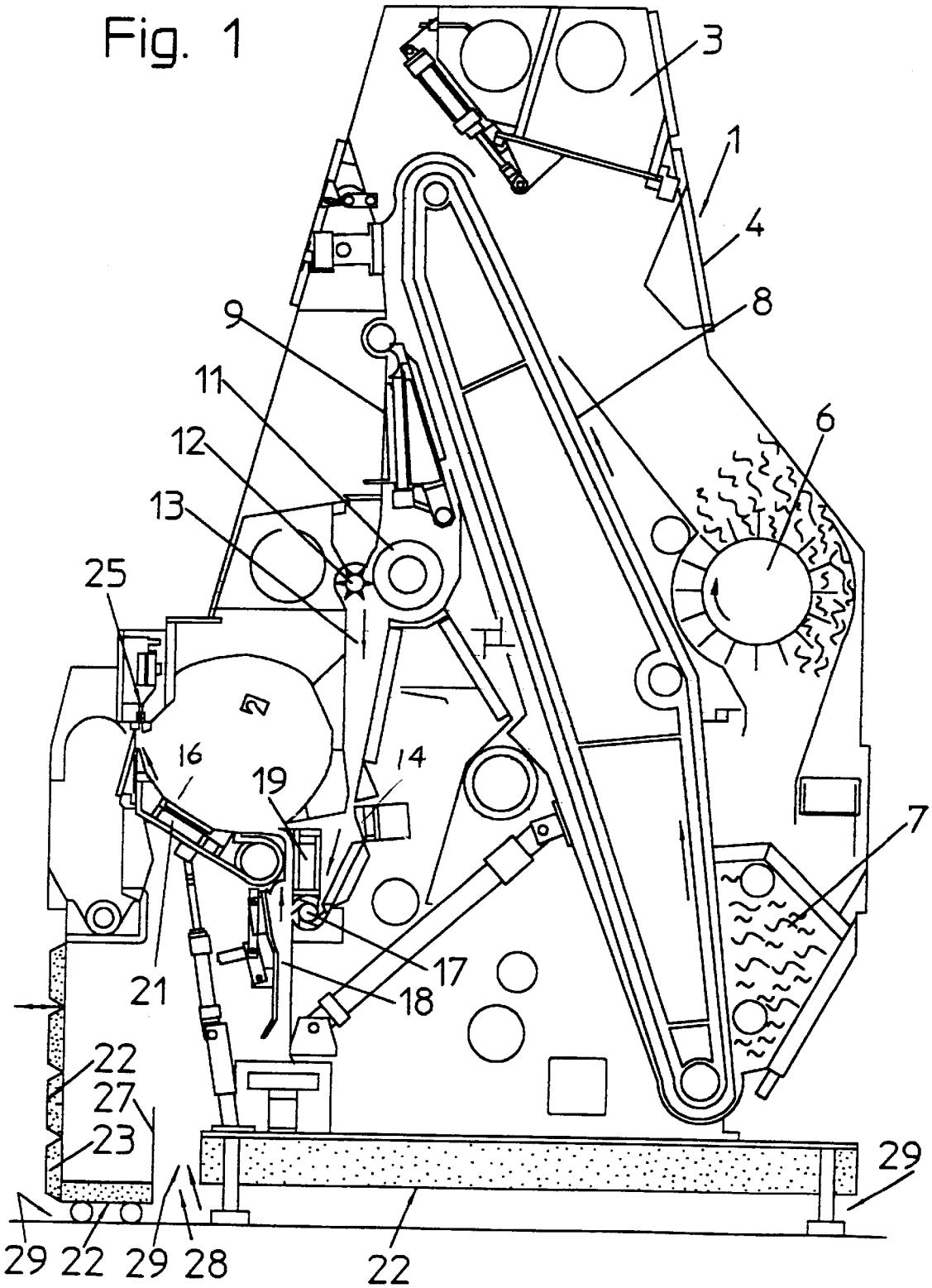
FIG. 1 is a sectional representation through the distributor of a cigarette-strand machine.
Figure 3:
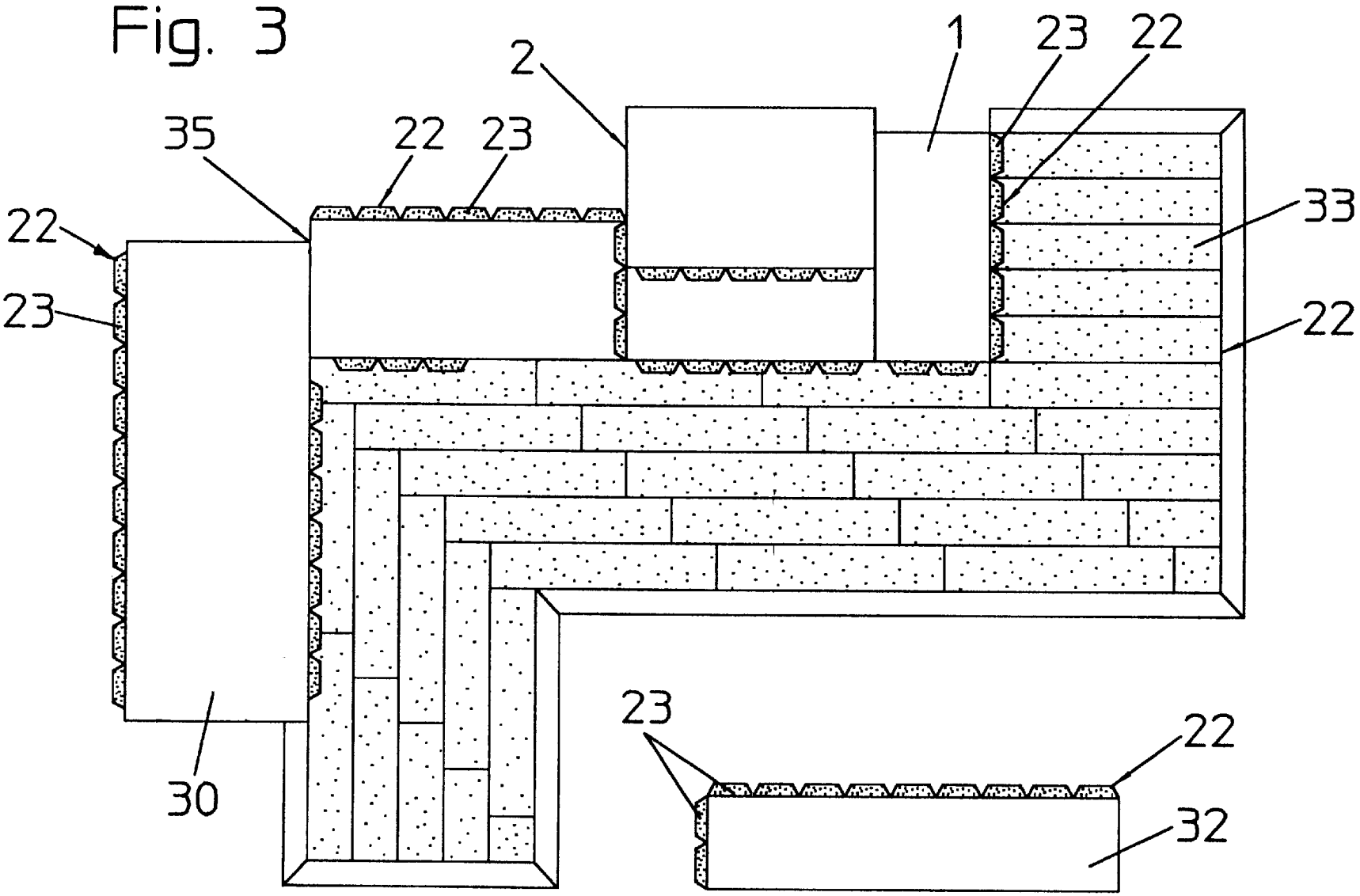
FIG. 3 is a plan view of an angular production line formed by a cigarette machine and a filter-attachment machine.

The distributor 1 illustrated in FIG. 1 is an aggregate of the cigarette-strand machine 2 according to FIG. 3, with a high throughput of flowing process air for the purpose of feeding and sorting tobacco and forming a tobacco strand from a stream of tobacco. The tobacco is fed in portions, via a pneumatic lock system 3, into a reservoir container 4 of distributor 1, transferred via a screen roller 6 into an intermediate storage element 7, then transported upward by a removal conveyor 8 equipped with carriers, and placed in a storage shaft 9, whose fullness level is kept essentially constant.

A removal roller 11 continuously removes tobacco from storage shaft 9 and, in cooperation with a beater roller 12, transfers it into a drop shaft 13.

At the lower exit of the drop shaft 13, a transverse sorting air current generated by high-pressure air nozzles 14 separates the tobacco into heavier and lighter tobacco fibers, of which the latter are transported to a concave guiding surface 16, while the former travel downward via a star-feeder lock 17 into a sorting shaft 18, from which heavy strands are removed at the bottom after a further sorting, and lighter tobacco fibers are transported upward due to the injector effect of a compressed-air jet generated by a further nozzle arrangement 19, then join the other tobacco fibers on the guide surface 16 to form a tobacco stream that extends over the width of the distributor 1 (perpendicular to the drawing plane), which is supported and accelerated by additional compressed air exiting a further nozzle arrangement 21 at the guide surface 16.

In this way, the tobacco stream is transferred upward to a suction strand conveyor 25 that is moved perpendicular to the drawing plane, and at which a tobacco strand is formed with the use of flowing suction air; this strand is encased and processed into individual cigarettes as it continues through the cigarette-strand machine 2.

The high air throughput effected by the numerous pneumatic conveyor elements creates an increased noise level in addition to the mechanical drive noises of the machine. This noise reaches the outside by way of unavoidable machine cladding gaps.

Figure 7:
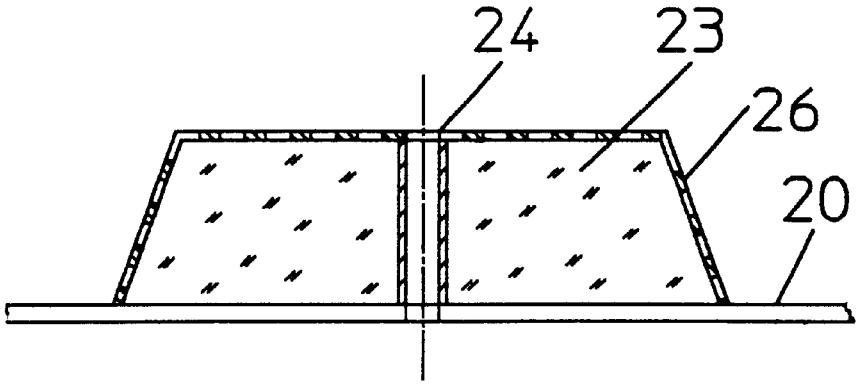
FIG. 7 a cross section through a sound-damping element of the machine cladding.
Figure 8:
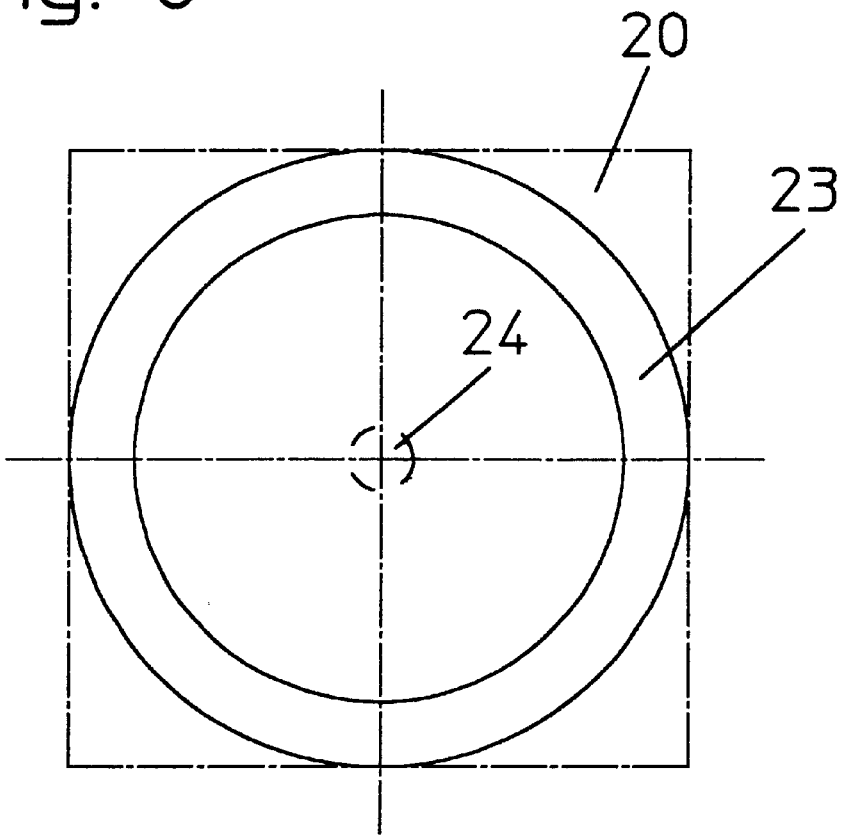
FIG. 8 a plan view of the sound-damping element according to FIG. 7.

In accordance with the invention, the outside machine walls, flaps, doors, hoods or carriages facing the operating space or the floor region, and acting as reflection surfaces, are provided to the greatest possible extent with noise-damping material in the form of damping mats 22, which are embodied with a neutral shape, such as frustoconical damping elements 23, in the region of the outside machine walls according to FIG. 7, and are connected by a central screw connection 24 to the machine cladding sheets of varying sizes so as to be easily exchanged.

According to FIG. 7, the damping elements 23 facing the operating space with their sound-damping structure are covered on all absorption surfaces with sound-permeable cladding sheets 26, which are provided with holes in the manner of a sieve.

The damping mats 22 on the machine floor are embodied to limit an air-intake opening 27 of sufficiently-large dimensions, and act as sound dampers 28 on the air 29 flowing in. In this way, the supply of process air is predominantly concentrated over the machine floor, instead of being conveyed via gaps in the front or rear machine cladding.

Figure 2:
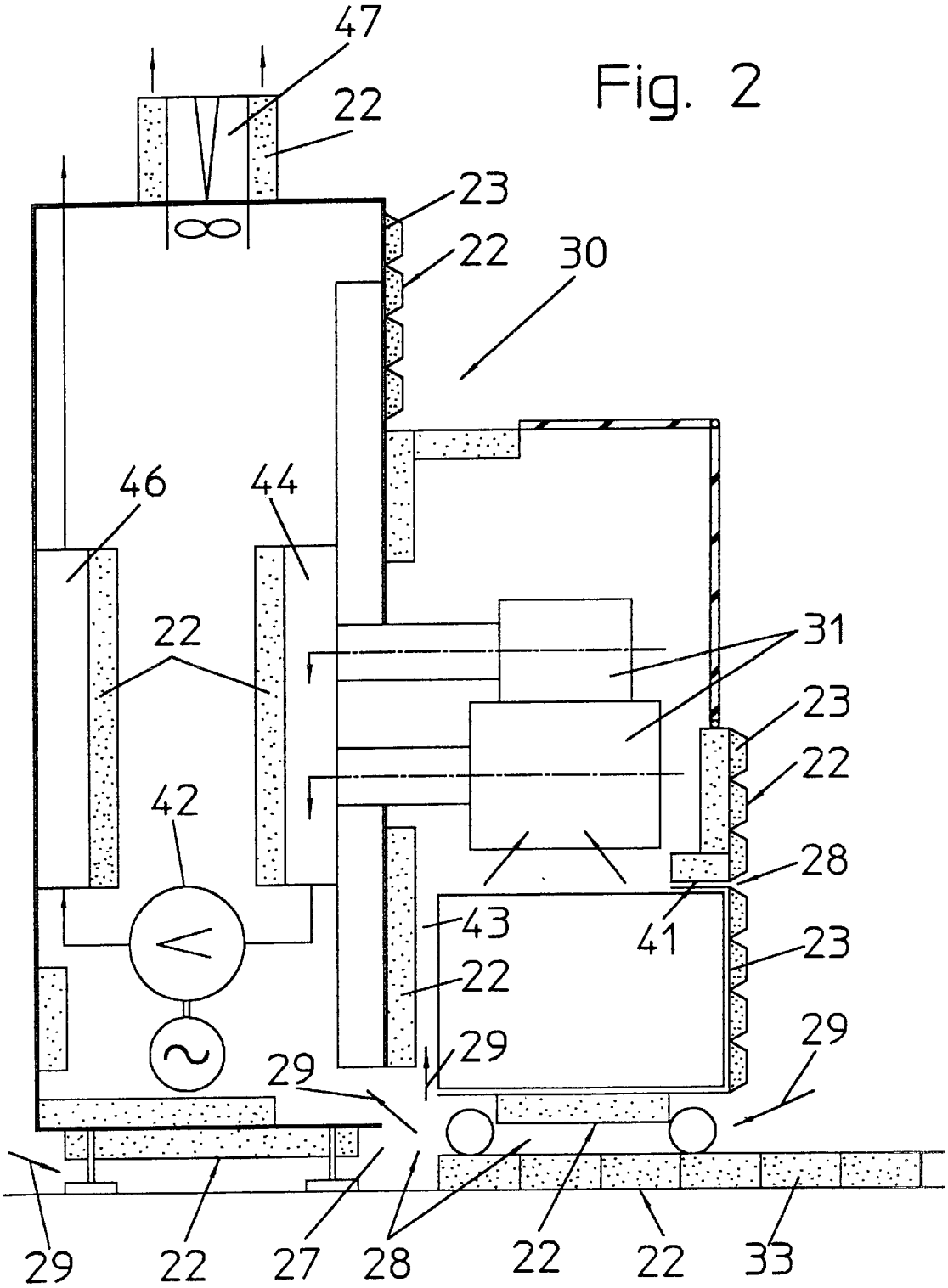
FIG. 2 is a sectional representation through a filter-attachment machine.

In the filter-attachment machine 30 shown in FIG. 2, which is likewise operated with a high air throughput for retaining rod-shaped tobacco articles in the cavities of conveyor drums 31, and for checking and separating out articles, damping mats 22 embodied in the same manner are mounted to the front and rear machine cladding, and on the machine floor, in the form of a sound damper 28 for a central air-intake opening 27.

In addition, a damping mat 22 is laid on the floor, at least from the standing region in front of the machine to beneath the machine floor.

Figure 4:
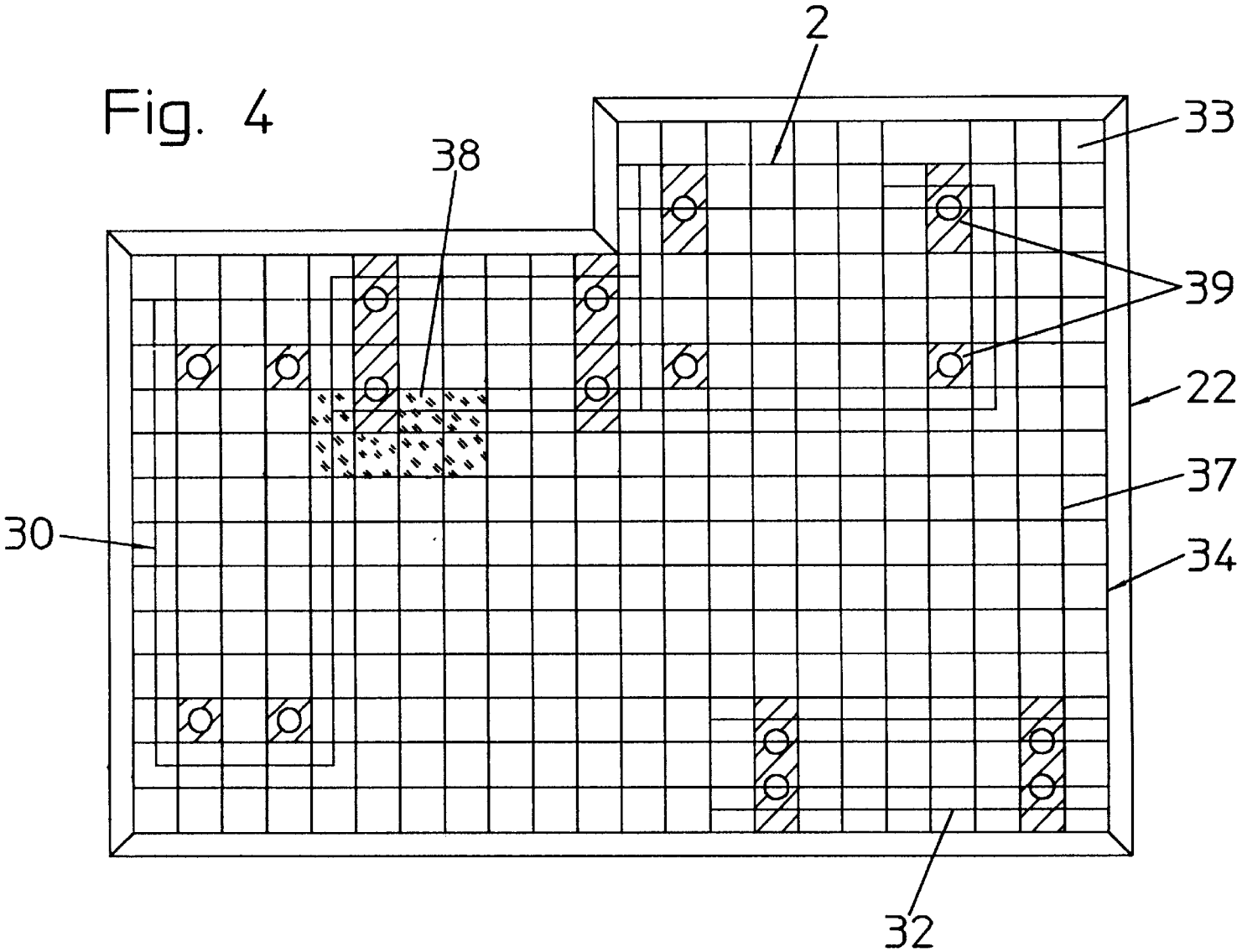
FIG. 4 a floor plan for sound-damping material for setting up the production line according to FIG. 3.
Figure 5:
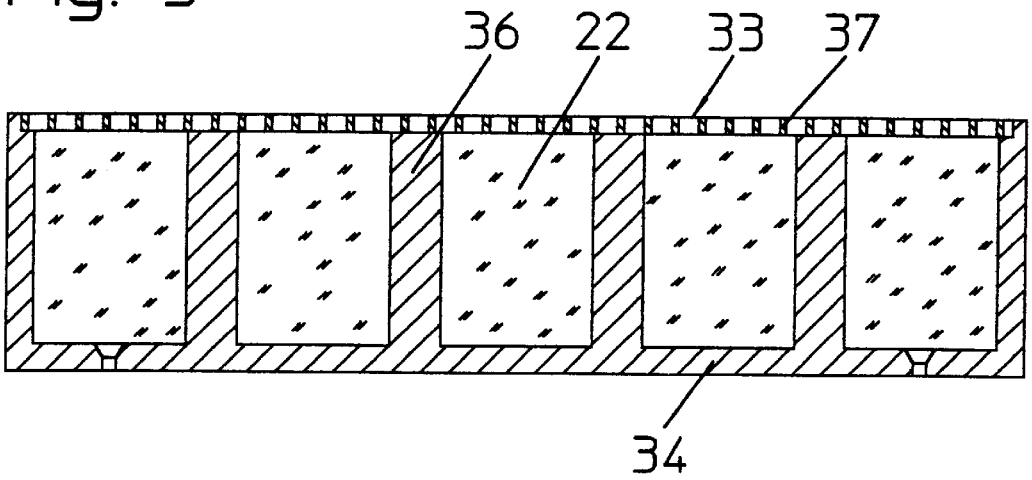
FIG. 5 a cross section through a tile element of the sound-damping material according to FIG. 4.
Figure 6:
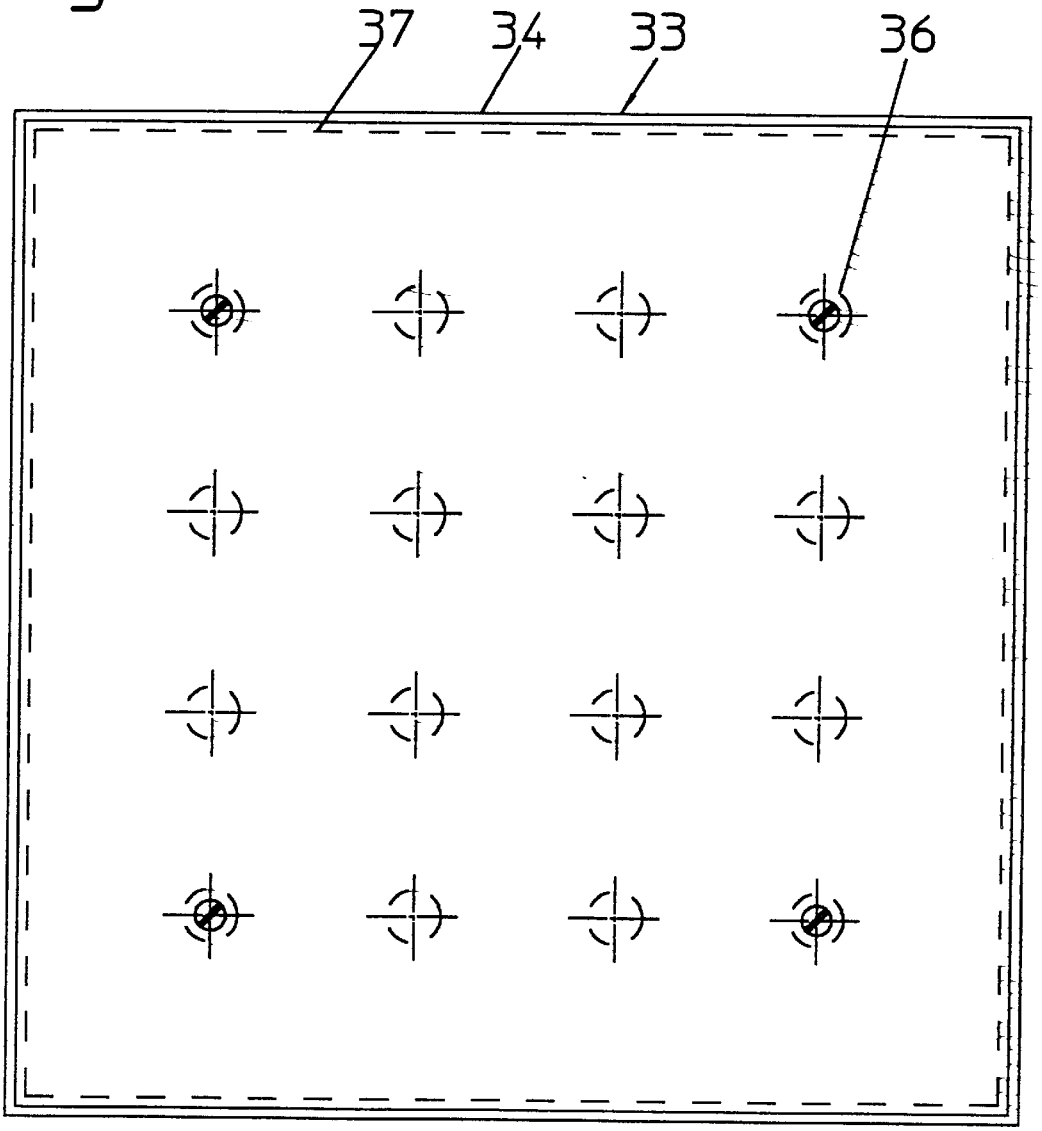
FIG. 6 a plan view of the tile element according to FIG. 5.

In the cigarette-strand machine 2 and filter-attachment machine 30 having a switch cabinet 32, and with the machines being set up at a closed right angle to form a production line 35 according to FIG. 3, the damping mat 22 is designed to cover the entire base surface of the production line 35 corresponding to FIG. 4. As the floor mat, the damping mat 22 comprises individual damping tiles 33, which, according to FIG. 5, are embodied as tile boxes 34 having supports 36 that are disposed in the manner of a grid, and are equipped with damping material in the form of damping mats 22 inserted with a precise fit. The tile boxes 34 as the standing surface are provided with a gridiron support 37 that is screwed to the supports 36.

Corresponding to the setup plan of the production line 35, stress-specific supports are inserted into the gridiron supports 37 according to FIG. 4, for example, at the locations with greater particle accumulation, in the form of easy-to-clean, closed plates 38, or under the machine bases in the form of reinforced support plates 39.

As a further anti-noise measure, according to FIG. 2, the remaining gaps 41 at the machines 2 and 30 are embodied to have the greatest possible sound-damping effect.

The air sucked in through a fan 42 is conveyed through sound-damped flow conduits 43, 44, 46 inside the machine, and carried off via an air exit 47 at the top of the machine, which further reinforces the sound damping.

In alternative embodiments of the damping elements illustrated in FIGS. 9 through 16, parts that correspond to those in the above-described arrangements are provided with reference numerals that are increased by one hundred.

Figure 10:
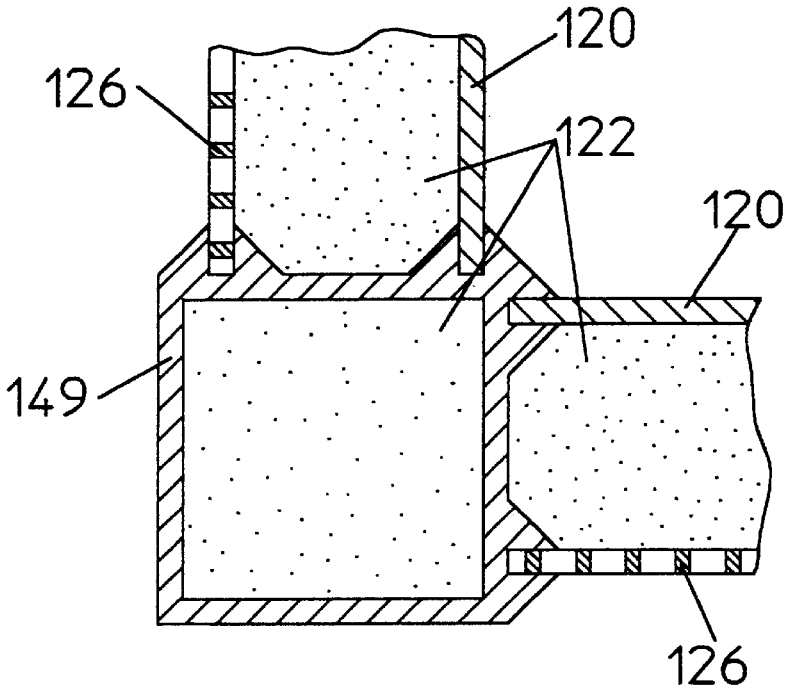
FIG. 10 a cross section through a corner profile strip of the carriage according to FIG. 9.
Figure 9:
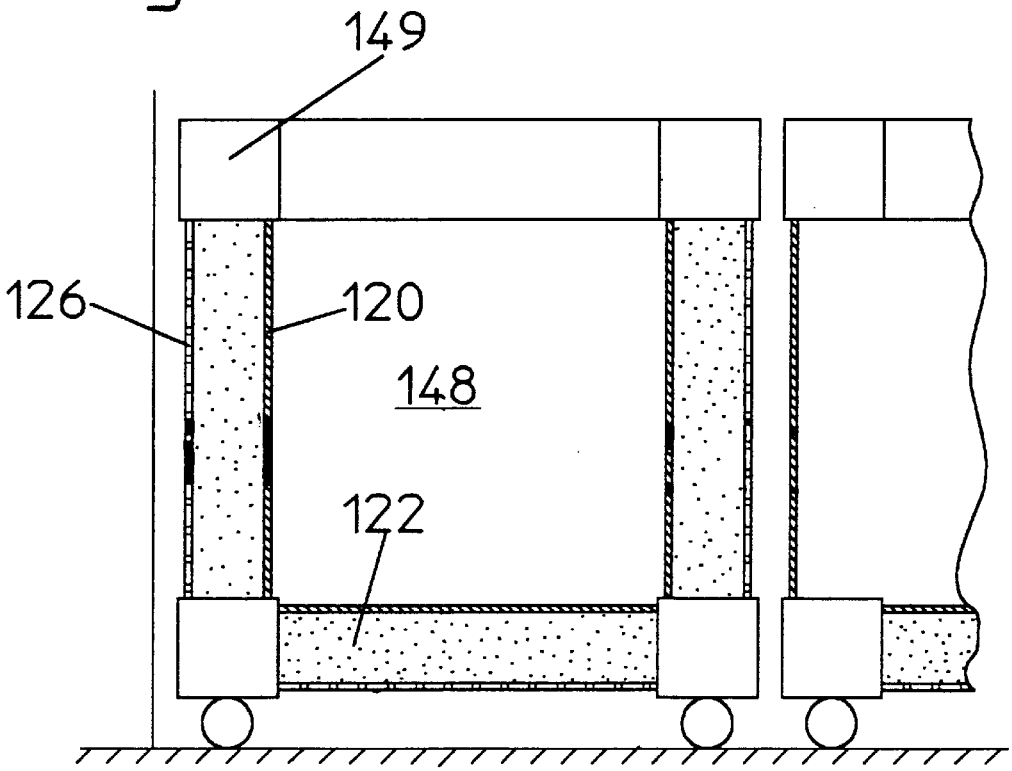
FIG. 9 an alternative damping cladding on a machine wall embodied as a removable carriage according to FIGS. 1 and 2.

In the carriages 148 illustrated on the outside of the machine in FIGS. 9 and 10, damping mats 122 are inserted laterally and underneath between inside reflection surfaces 120 and outside, sound-permeable cladding sheets 126, and into corner-profile strips 149, with the plate-shaped reflection surfaces 120 and cladding sheets 126 being inserted into the correspondingly-spaced receiving grooves of corner-profile strips 149.

Figure 11:
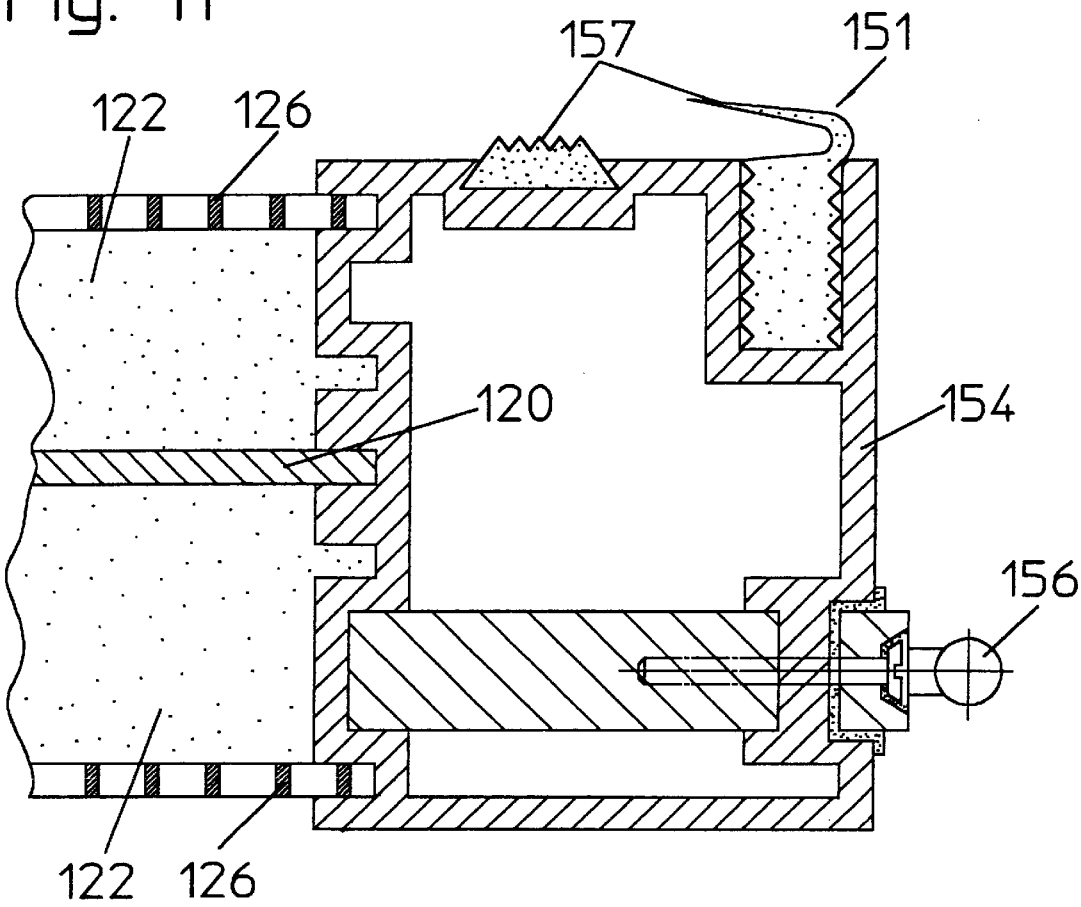
FIG. 11 a cross section through an alternative damping profile on a machine cladding embodied as a door.
Figure 12:
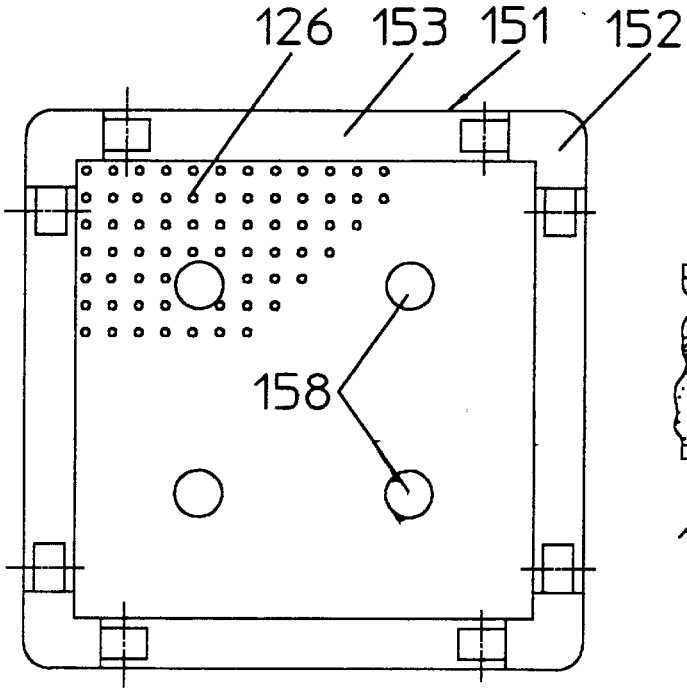
FIG. 12 a front view of the door according to FIG. 11.
Figure 13:
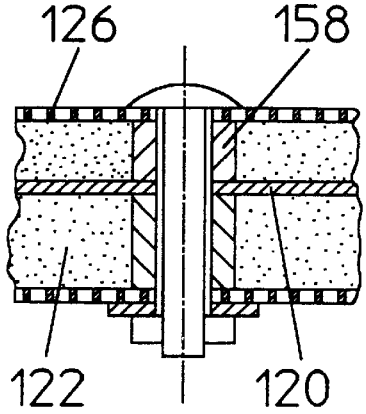
FIG. 13 a cross section through a detail of the door damping profile.

In the machine cladding embodied as a door 151 in FIGS. 11 through 13, inside and outside sound-permeable cladding sheets 126 with interposed reflection surfaces 120 are inserted into receiving grooves of four profile strips 154 joined by corner connectors 152 to form a profile frame 153. The hollow spaces formed in the process are filled with damping mats 122.

Sealing elements 157 are inserted into the profile frame 153, which can pivot about an axis 156. The cladding sheets 126 and the reflection surface 120 are stabilized against shifting by spacing sleeves 158 that are screwed together.

Figure 14:
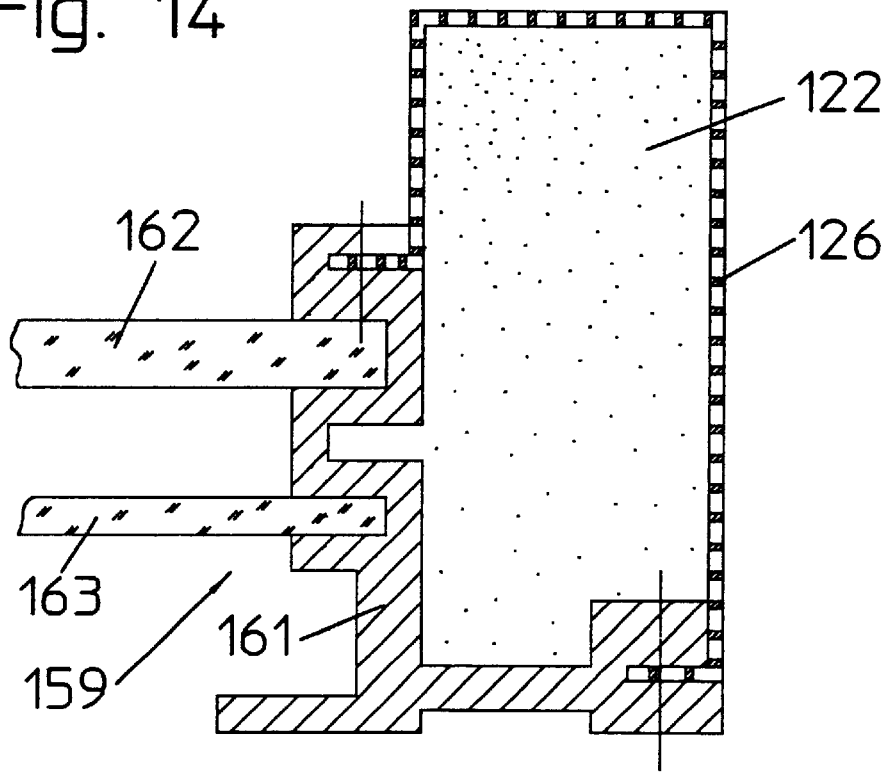
FIG. 14 a cross section through a damping profile of a machine cladding embodied as a see-through flap.
Figure 17:
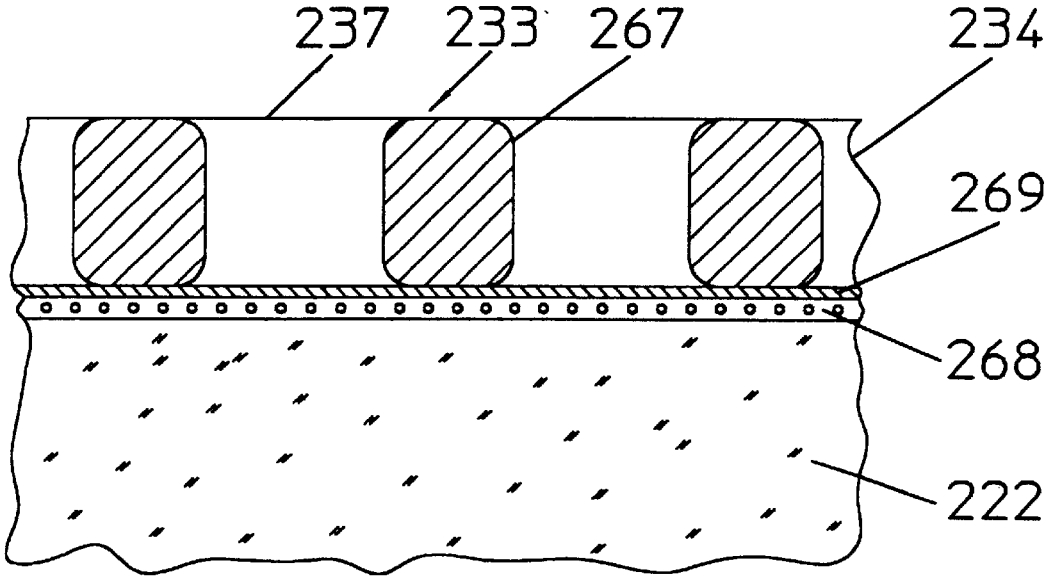
FIG. 17 a partial cross section through a further embodiment of the damping tile.

In the window flap 159 illustrated in FIG. 14, two viewing panes 162 and 163, and a cladding sheet 126, are inserted as a double glazing into a profile strip 161 of a window frame. The cladding sheet limits a hollow space that is filled with damping mats 122.

Figure 15:
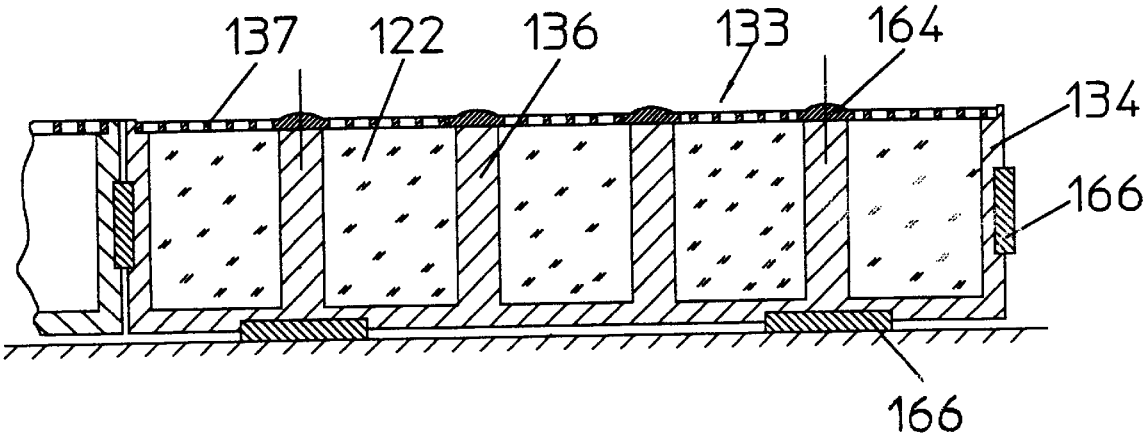
FIG. 15 a cross section through an alternative damping tile for covering the floor.
Figure 16:
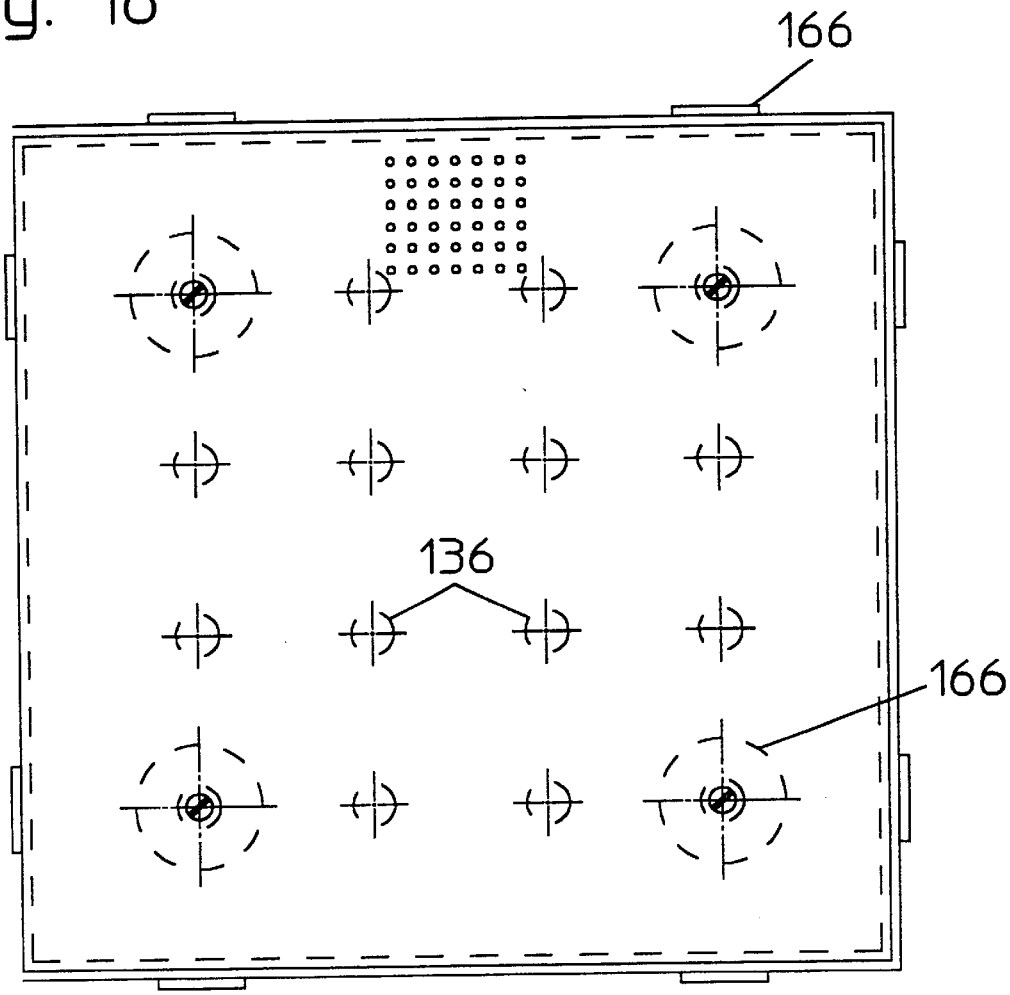
FIG. 16 a plan view of the damping tile according to FIG. 15.

In the alternative tile box 134 of a damping tile 133 covering the floor, as shown in FIGS. 15 and 16, the gridiron support 137 is provided with elevations 164 in a specific lattice or grid arrangement of the supports 136; these elevations prevent tobacco fibers that are lying on the gridiron support 137 from entering the damping mats 122, and allows them to be swept away more easily.

Furthermore, buffers 166, which prevent a solid-borne sound transmission between the damping tiles, and into the floor, are inserted, on the side and bottom, between the damping tiles 133.

As the last embodiment, in a floor-damping tile 233, a gridiron support 237 is provided with rounded edges 267 and a sound-permeable film 269, which is inserted between a narrow-mesh sieve 268 that lies on the damping mat 222 and the gridiron support 237, the film preventing the passage of fine particles into the damping material.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for reducing noise level in at least one tobacco-processing production machine that is acted upon by flowing process air, comprising:

conveying flowing process air through sound-damping line segments disposed in a floor region outside of an exterior enclosure of the production machine to reduce noise in the flowing process air; and supplying said flowing process air to the production machine through an opening in said exterior enclosure.

2. The method according to claim 1, wherein the at least one tobacco-processing production machine comprises two production machines, and the method further comprises:

disposing said two production machines at an angle to one another to form a production line and defining an operator region; whereby noise level in the operator region is reduced.

3. The method according to claim 2, further comprising integrating a sound-absorbing covering on the floor beneath the exterior enclosure of the production machines into the sound-damping line segments.

4. The method according to claim 2, wherein the production line includes movable and stationary machine or wall sections, and wherein the method further comprises:

defining at least one secondary air-flow gap between the movable and stationary machine or wall sections; and employing the at least one secondary air-flow gap as a sound damper.

5. The method according to claim 4, further comprising providing the production machines with cladding of damping mats for sound-damping the at least one secondary air-flow gaps.

6. The method according to claim 1, wherein the at least one production machine has a top with at least one air-exit opening, and the method further comprises sound-damping the at least one air-exit opening.

* * * * *